United States Patent [19]

Palmer et al.

[11] Patent Number: 4,780,049

[45] Date of Patent: Oct. 25, 1988

[54] COMPRESSOR

[76] Inventors: Lynn D. Palmer, 616 Southern Way, Spanish Fort, Ala. 36527; David R. Donaldson, 107 Dewitt Loop, Daphne, Ala. 36526; Donald L. Carriere, 35611 Six Mile, Livonia, Mich. 48154; Christian J. Rahnke, 425 Still Meadow, Orchard Lake, Mich. 48033; Rogelio G. Samson, 1738 Golf Ridge Dr., S., Bloomfield Hills, Mich. 48013; Antoni Paluszny, 939 Forest Rd., Ann Arbor, Mich. 48015

[21] Appl. No.: 869,683

[22] Filed: Jun. 2, 1986

[51] Int. Cl.[4] ..... F04D 27/00; F04D 29/46

[52] U.S. Cl. ..... 415/36; 415/48; 415/149 R; 415/150

[58] Field of Search ..... 415/13, 17, 32, 36, 415/39, 43, 48, 47, 149 R, 162, 163, 164; 417/374

[56] References Cited

U.S. PATENT DOCUMENTS

| | | | |
|---|---|---|---|
| 2,271,415 | 1/1942 | Conlon | 417/374 X |
| 2,645,410 | 7/1953 | Bauger et al. | 415/149 R X |
| 2,781,831 | 2/1957 | Angell | 417/374 X |
| 3,799,694 | 3/1974 | Duzan | 415/163 X |
| 3,930,746 | 1/1976 | Kronogard | 415/149 R |
| 3,946,554 | 3/1976 | Neumann | 415/149 A X |
| 3,981,140 | 9/1976 | Lunsford et al. | 415/149 R X |
| 4,156,578 | 5/1979 | Agar et al. | 415/17 X |
| 4,325,673 | 4/1982 | Hall, Jr. | 415/164 X |

FOREIGN PATENT DOCUMENTS

| | | | |
|---|---|---|---|
| 2839027 | 3/1979 | Fed. Rep. of Germany | 415/17 |
| 987193 | 1/1983 | U.S.S.R. | 415/17 |

*Primary Examiner*—Robert E. Garrett
*Assistant Examiner*—Joseph M. Pitko
*Attorney, Agent, or Firm*—Gifford, Groh, VanOphem, Sheridan, Sprinkle and Dolgorukov

[57] ABSTRACT

A compressor with a rotary driven centrifugal impeller which receives inlet air from an inlet passageway and this discharges compressed air through a radially extending diffuser passageway. Moveable vanes are provided both in the inlet passageway and diffuser passageway for varying the pressure and flow output from the compressor while maintaining the rotary speed of the centrifugal impeller substantially constant. In the preferred form of the invention, the centrifugal impeller and an electrical generator are rotatably driven at a constant speed and in synchronism with each other and, together, form an electrical and pneumatic power system.

11 Claims, 4 Drawing Sheets

COMPRESSOR

BACKGROUND OF THE INVENTION I. Field of the Invention

The present invention relates generally to air compressors and, more particularly, to a compressor having variable geometry inlet nozzle and diffuser assemblies.

II. Description of the Prior Art

There are a number of previously known turbine compressors which comprise a housing having a centrifugal impeller which is rotatably mounted within the housing. An inlet passageway extends from one axial end of the impeller and to an inlet formed in the housing. The impeller is rotatably driven by any conventional means and, in doing so, inducts air through the inlet passageway and discharges compressed air through a diffuser passageway extending radially outwardly from the other end of the impeller.

In many applications, it is desirable to vary both the pressure output and air flow rate from the compressor. In order to achieve variable pressure and flow output from the compressor, many of the previously known devices vary the rotational speed of the impeller until the desired pressure and flow output is obtained.

Furthermore, it is often desirable to combine the compressor with an electrical generator, for example, when the electrical generator and compressor are employed as a start cart for starting and/or servicing aircraft engines. Different aircraft engines, of course, require different pneumatic pressures and air flow rates.

In a start cart, the electrical generator and compressor are typically driven by a single motor. The electrical generator, however, must be driven at a substantially constant speed in order to provide an alternating current electrical output at a predetermined frequency, typically 400 hertz. Conversely, the compressor must be driven at different rotational speeds in order to match the required pressure and air flow output of the compressor to the aircraft engine. Consequently, these previously known start carts have employed either a hydrostatic transmission to mechanically maintain a constant generator speed or they have employed a variable speed, constant frequency (VSCF) system coupled to the generator output which electronically converts a variable frequency output from the generator to a constant frequency output.

These previously known hydrostatic transmissions and VSCF systems, however, are not only expensive in construction but also degrade the overall power efficiency of both the start cart compressor and electrical generator systems.

SUMMARY OF THE PRESENT INVENTION

The present invention provides a constant speed and variable pressure and flow output compressor which overcomes the above-mentioned disadvantages of the previously known devices.

In brief, the compressor of the present invention comprises a housing in which a centrifugal impeller is rotatably mounted. An inlet passageway is formed in the housing between one axial end of the impeller and an inlet formed in and open exteriorly of the housing. The other or outlet end of the impeller is open to an annular diffuser passageway which extends radially outwardly from the axis of the impeller.

A plurality of inlet vanes are pivotally mounted to the housing and extend into the inlet passageway between the compressor inlet and the impeller to form the inlet nozzle. A control ring is rotatably mounted to the compressor housing around the inlet passageway and is mechanically connected to the inlet vanes so that the rotation of the control ring simultaneously pivots the inlet vanes between an open and a closed position. Conventional means, such as a hydraulic actuator, are used to variably rotate the control ring and thus vary the aerodynamic geometry of the inlet nozzle.

Similarly, a plurality of diffuser vanes are pivotally mounted to the turbine housing within the diffuser passageway so that the diffuser vanes are movable between an open and a closed position. A diffuser control ring is mechanically coupled with the diffuser vanes so that rotation of the diffuser control ring simultaneously pivots the diffuser vanes to any desired position between their open and closed position. Any conventional means, such as a hydraulic actuator, is used to control the rotational position of the diffuser control ring and thus the aerodynamic geometry of the diffuser passageway.

In practice, the pressure and flow output from the compressor can be varied by varying the geometry of the inlet and/or diffuser passageway while maintaining a substantially constant rotational speed of the centrifugal impeller.

In the preferred form of the invention, the compressor is coupled with an electrical generator and used in a start cart for aircraft. Since the compressor delivers variable pressure and flow despite a constant rotational speed of the impeller, the drive shaft for both the impeller and the electrical generator on a start cart are directly mechanically coupled together through a gearing arrangement. This direct mechanical connection thus eliminates the previously known necessity for hydrostatic transmissions or VSCF systems to control the generator frequency.

In the preferred form of the invention, a microprocessor based control system is employed to control the actuation of the diffuser and inlet control rings to obtain the desired pressure and flow output from the compressor. Preferably, the control system includes one or more switches which enable the operator to input the desired pressure and flow output from the compressor. For example, in one form of the invention, the operator simply enters the aircraft type via the switch(es) and the microprocessor then determines the required pressure output and flow rate from the compressor from values prestored in memory and accessible to the microprocessor.

BRIEF DESCRIPTION OF THE DRAWING

A better understanding of the present invention will be had upon reference to the following detailed description when read in conjunction with the accompanying drawing, wherein like reference numerals refer to like parts throughout the several views, and in which.

DETAILED DESCRIPTION OF A PREFERRED EMBODIMENT OF THE PRESENT INVENTION

Figure 1:
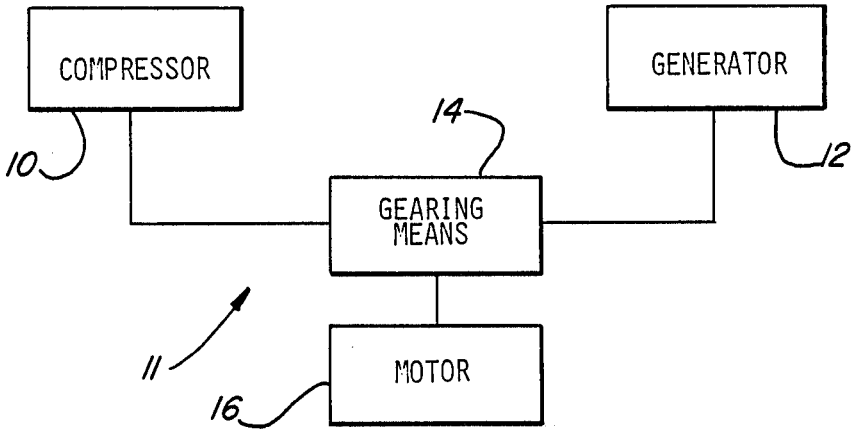
FIG. 1 is a diagrammatic view illustrating a preferred embodiment of the present invention.

With reference first to FIG. 1, a diagrammatic view of a compressed air and electrical generator system 11 is thereshown and comprises an air compressor 10 and an alternating current electrical generator 12. Both the compressor 10 and generator 12 include rotary driven input shafts which are directly mechanically coupled together by a gearing arrangement or means 14 so that the compressor 10 and generator 12 rotate in synchronism with each other. Any conventional means, such as a motor 16, is employed to simultaneously drive the compressor 10 and generator 12 at a predetermined rotational speed. Since the generator 12 is an alternating current generator, it must be rotatably driven at a substantially constant speed in order to obtain the desired frequency output.

Figure 2:
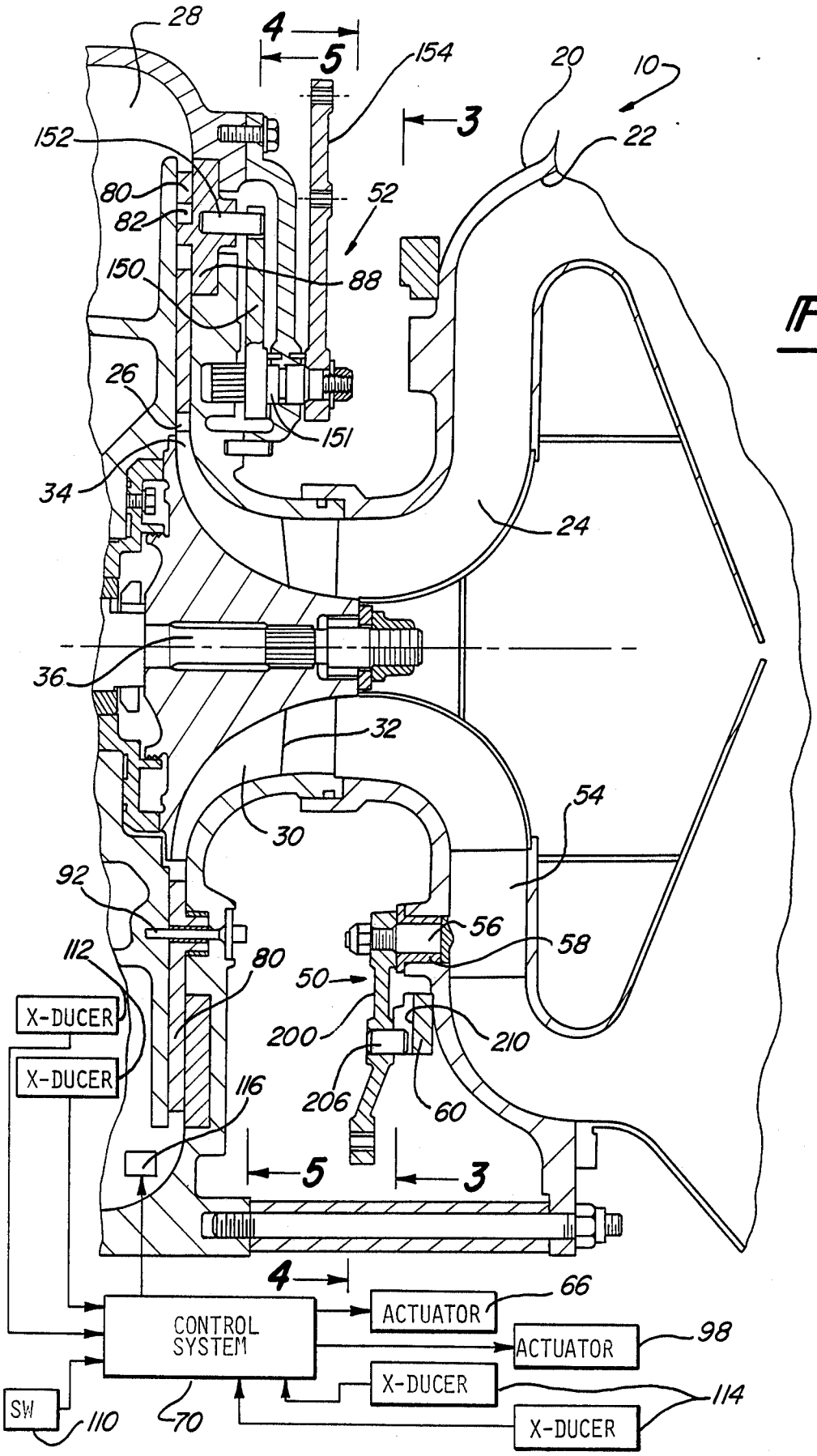
FIG. 2 is a fragmentary sectional view of the compressor section of the present invention and with parts removed for clarity.

With reference now particularly to FIG. 2, a portion of the compressor 10 is thereshown in greater detail and comprises a housing 20 having an air inlet 22. The air inlet 22 is open to a radially extending air inlet passageway 24 formed within the housing 20. An inner end of the air inlet passageway 24 diverges outwardly into a radially extending annular diffuser passageway 26. The outermost radial end of the diffuser passageway 26 is open to an output chamber or plenum 28.

Referring still to FIG. 2, a centrifugal impeller 30 is coaxially positioned within the inlet passageway 24 so that an outer end 32 of the impeller 30 is open to the air inlet 22 while its inner end 34 is open to the radial inner end of the diffuser passageway 26. The impeller 30 is secured to a main shaft 36 which, in turn, is rotatably mounted to the housing 20 by any conventional means so that the impeller 30 rotates coaxially within the inlet passageway 24. The shaft 36 is rotatably driven by the motor 16 (FIG. 1) via the gearing means 14 and, in doing so, inducts air through the air inlet 22 and discharges compressed air through the diffuser passageway 26 and into the plenum 28.

As previously described, the motor 16 rotatably drives the compressor shaft 36, and thus the impeller 30, at a substantially constant speed. For different applications, however, it is necessary that both the pressure and air flow output from the compressor vary in accordance with the desired application. For example, assuming that the compressed air and generator system 11 is used as a start cart for aircraft, the required compressed air pressure and air flow will vary from aircraft to aircraft.

Figure 4:
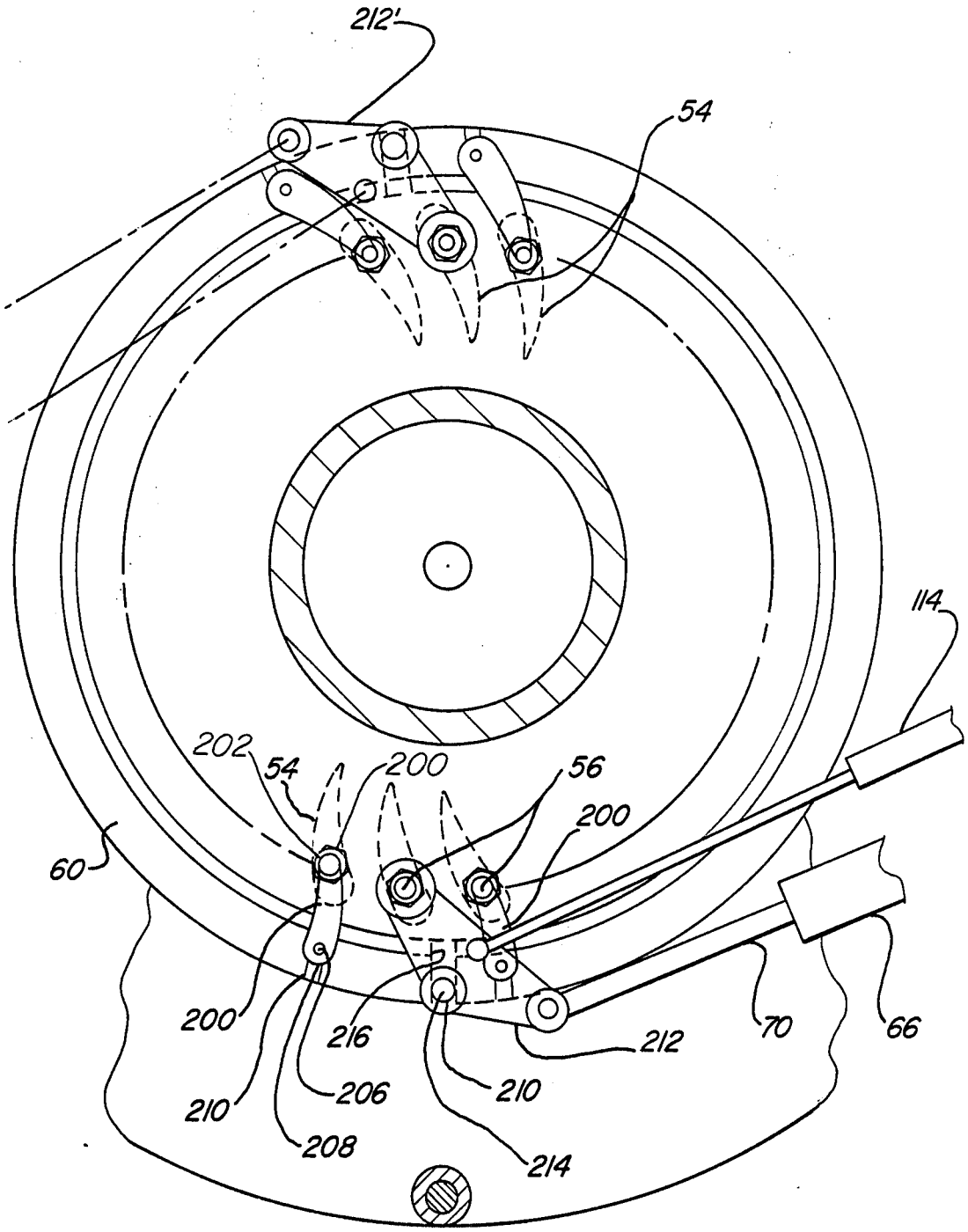
FIG. 4 is a diagrammatic view taken along line 4—4 in FIG. 2.

In order to vary both the pressure and flow output from the compressor 10, the present invention employs a variable geometry inlet nozzle assembly 50 and a variable geometry diffuser assembly 52. With reference now particularly to FIGS. 2 and 4, the inlet nozzle assembly 50 comprises a plurality of circumferentially spaced inlet vanes 54 which are positioned within the inlet passageway 24 between the inlet end 32 of the impeller 30 and the air inlet 22. Each vane 54 is mounted to a shaft 56 having an axis which is parallel to, but radially spaced from, the axis of rotation of the impeller 30.

The shafts 56 are each rotatably mounted by sleeve bearings 58 (FIG. 2) to the compressor housing 20 so that the vanes 54, as well as the shafts 56, are circumferentially equidistantly spaced from each other around the inlet passageway 24 as best shown in FIG. 4.

Still referring to FIGS. 2 and 4, an actuating ring is rotatably mounted to the housing 20 coaxially around the vane shafts 56. A link 200 is associated with each vane 54 and each link 200 has its inner end 202 secured to its associated vane 54 by a nut 204 so that the vane 54 and its link 200 pivot in unison with each other. A pin 206 attached to an outer end 208 of each link 200 is slidably received in a slot 210 in the ring 60. Consequently, rotation of the ring with respect to the housing simultaneously pivots the vanes in unison with each other.

Figure 3:
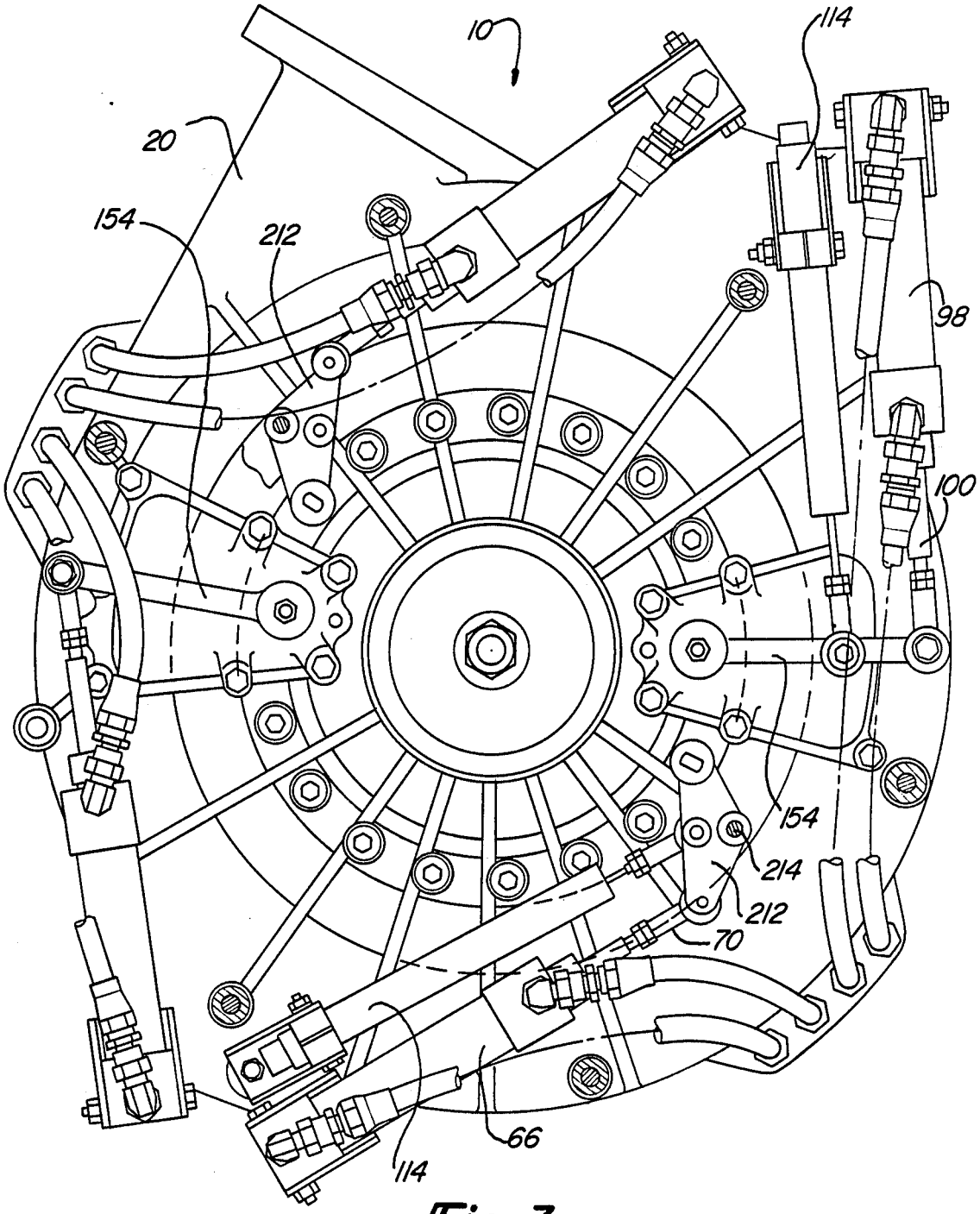
FIG. 3 is a view of the compressor section of the preferred embodiment of the invention and taken substantially along line 3—3 in FIG. 2.

With reference now to FIGS. 3 and 4, in order to rotate the ring 60 and thus pivot the vanes 54, at least one activating link 212 replaces one of the links 200. Like the links 212, the control link 212 is attached to its associated vane 54 and has a pin 214 slidably mounted in a slot 216 on the ring 60. Unlike the links 200, however, a hydraulic actuator 66 is pivotally connected to the control link 212 so that extension and retraction of a rod 70 of the actuator 66 rotates the ring 60. A second control link 212′ and activator (not shown) are preferably also operatively connected to the ring 60 for redundancy.

With reference to FIGS. 2–4, a control system 70 (FIG. 2) generates output signals to control the activation of the hydraulic actuator 66 and thus to control the position of the piston rod 70 between a fully extended and fully retracted position as well as any intermediate position therebetween. In its fully retracted position, the piston rod 70 rotates the inlet vanes 54 to their fully closed position thus limiting the air flow from the air inlet 22 and to the impeller 30 to an amount desirable for cooling purposes. Conversely, in its fully extended position, the piston rod 70 rotates the inlet vanes 54 to their fully open position.

Figure 5:
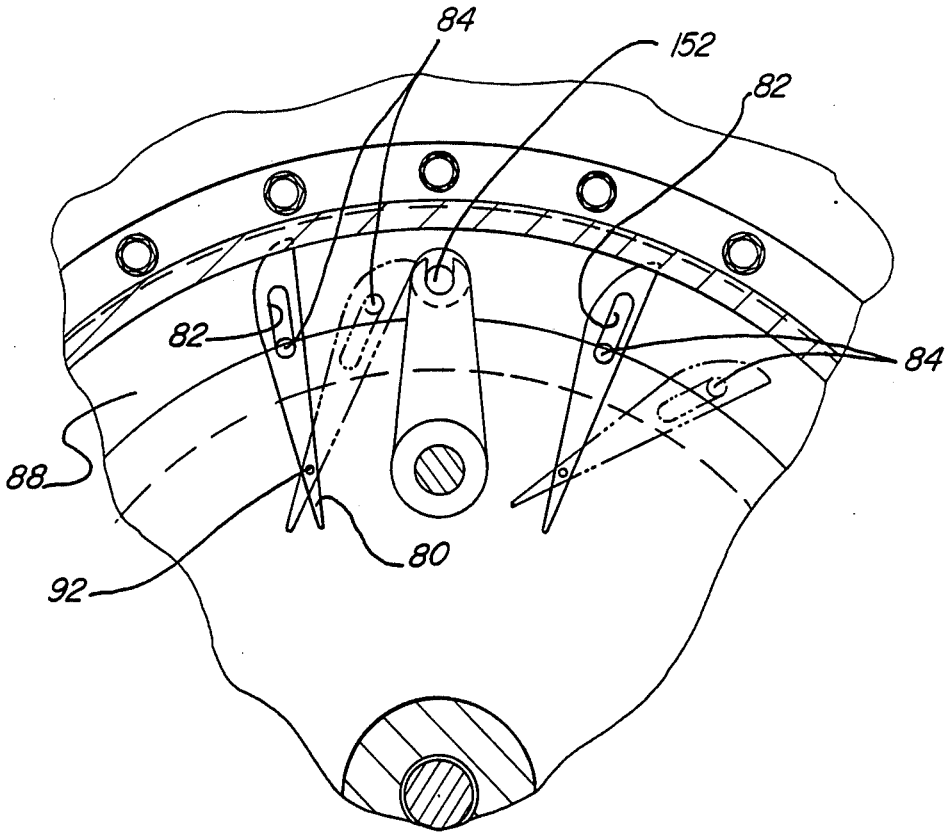
FIG. 5 is a diagrammatic view taken along line 5—5 in FIG. 2.

With reference now particularly to FIGS. 2 and 5, the diffuser assembly 52 includes a plurality of diffuser vanes 80 which are circumferentially equidistantly spaced from each other and positioned within the diffuser passageway 26. An elongated slot 82 is formed in the outermost end of each diffuser vane 80 while a pin 84 extends through the slot 82 and is secured against movement to a ring 88 rotatably mounted in the housing 20. The pin 84 is dimensioned so that the vane 80 can slide along the pin 84 within the limits of the slot 82.

As best shown in FIGS. 2 and 5, the ring 88 is rotatably mounted to the compressor housing 20 so that the ring 88 is coaxial with the axis of the impeller 30. A plurality of circumferentially spaced pins 92 are secured to the housing 20 and one pin 92 pivotally extends through a bore in each diffuser vane 80 adjacent its radial inner end. Thus, rotation of the ring 88 in the counter clockwise as viewed in FIG. 5 simultaneously pivots the diffuser vanes 80 from their open position, shown in solid line, and to their closed position, shown in phantom line. The rotation of the ring 88 in the counterclockwise direction also simultaneously slidably moves the diffuser vanes 80 along their associated pins 84.

Although any means can be used to control the actuation of the ring 88, in the preferred form of the invention, an inner end of an actuating arm 150 is pivotally mounted to the housing 20 by a pivot pin 151. The outer end of the arm 150 is mechanically connected to the ring 88 by a pin 152 so that pivotal movement of the arm 150 rotates the ring 88.

Referring now to FIGS. 2 and 3, an inner end of an actuating lever 154 is also connected to the pin 151 so that the pin 151, lever 154 and arm all pivot or rotate in unison with each other.

A hydraulic actuator 98 (FIG. 3) has its piston rod 100 pivotally secured to the outer end of the lever 154. Consequently, the extension or retraction of the piston rod 100 from its cylinder 98 pivots the lever 154 and arm 150 and thus rotatably drives the ring 88. As before, the control system 70 (FIG. 2) controls the actuation of the hydraulic actuator 98 between its fully extended and fully retracted position or any intermediate position therebetween.

The activation of the actuators 66 and 98 respectively varies the aerodynamic geometry of the inlet passageway 24 and diffuser passageway 26. The aerodynamic geometry controls both the pressure and flow output from the compressor 10 despite the constant speed of rotation of the compressor impeller 30.

With reference now particularly to FIG. 2, as has been previously described, the control system 70 is used to vary the geometry of both the inlet diffuser passageway via the actuators 66 and 98. The control system 70 receives input from an operator through one or more switches 110 of the desired pressure and flow output from the compressor 10. When the system 11 is used an an aircraft start cart, the operator preferably enters the aircraft type through the switch(es) 110 whereupon the control system 70 determines the necessary pressure and flow characteristics from prestored values in the control system 70. The control system 70 then generates output signals to the actuator 66 and 98 to obtain the necessary pressure and flow output.

In order to adjust the variable geometry assemblies 50 and 52 to compensate for changes in air temperature, humidity and the like, the compressor preferably includes a plurality of sensors 112 (only two shown) which also provides input signals to the control system 70. The control system 70, which is preferably microprocessor based, varies the actuation of the actuators 66 and 98 to compensate for these environmental factors. These sensors 112 can, for example, comprise temperature, flow, pressure and/or humidity sensors. In addition, a Kiel probe is preferably used to measure air flow.

With reference now to FIGS. 2 and 3, a position transducer 114 is preferably associated with each actuator 66 and 98 which produces an electrical output signal representative of the degree of actuation of its actuator 66 or 98. The outputs from the position transducers 114 are coupled as input signals to the control system 70 and provide a feedback signal to the control system of the actual position of the actuators 66 and 98.

With reference particularly to FIG. 2, a bleed valve 116 (illustrated diagrammatically) is coupled to and controlled by the control system 70. In the conventional fashion, the bleed valve 116, when actuated, vents excessive pressure in the plenum 28 to prevent compressor surge. In addition, however, the control system 70 is programmed to move the diffuser vanes 80 and inlet vanes 54 to their closed position in the event of surge in order to preclude subsequent compressor surge and eliminate cyclic surging common to the previously known compressors.

From the foregoing, it can be seen that the present invention provides a constant speed compressor and alternating current system which is particularly useful as a start cart for starting or servicing aircraft. Furthermore, since both the compressor and generator are driven in synchronism with each other and at a constant speed, the previously known necessity for a hydrostatic transmission or VSCF system to control the generator frequency is rendered unnecessary thus reducing the overall cost and complexity of the present system.

The variable geometry inlet and diffuser assemblies also maximize the efficiency of the compressor since the power consumed by the compressor is directly proportional to the power output required from the compressor. For example in some instances, compressed air is not required at all and, by closing the inlet nozzle assembly 50 and diffuser assembly 52, the compressor power consumption is reduced to only the power necessary to overcome the friction and inertia of the system and to provide a small air flow through the compressor for cooling purposes.

Having described my invention, however, many modifications thereto will become apparent to those skilled in the art to which it pertains without deviation from the spirit of the invention as defined by the scope of the appended claims.

We claim:

1. A compressor comprising:

a housing having an inlet and an outlet, an impeller, means for rotatably mounting said impeller to said housing about an axis, said housing having an inlet and an inlet passageway extending axially from said inlet and to one end of said impeller, said housing having a diffuser passageway extending substantially radially outwardly from the other end of said impeller, a plurality of inlet vanes, means for pivotally mounting said inlet vanes in said inlet passageway so that said vanes are pivotal between an open and a closed position, means for variably pivotally moving said inlet vanes in synchronism with each other, Serial No. 869,683--2 a plurality of diffuser vanes, means for pivotally mounting said diffuser vanes in said diffuser passageway so that said diffuser vanes are pivotal between an open and a closed position, and means for variably pivotally moving said diffuser vanes between an open and a closed position, said diffuser vanes moving means being independent of said inlet vanes moving means, wherein said moving means for said inlet vanes and said diffuser vanes comprises a control circuit having means for computing the pivotal position of said inlet and diffuser vanes to produce a user selected pressure and air flow at a preset rotational speed of said impeller, said control circuit having first means for generating an output signal to said means for moving said inlet vanes and second means for generating an output signal to said means for moving said diffuser vanes, said first and second means being independent of each other.

2. The invention as defined in claim 1 wherein said control circuit comprises an air temperature transducer.

3. The invention as defined in claim 1 wherein said control circuit comprises a Kiel probe.

4. The invention as defined in claim 1 wherein said control circuit comprises a pressure transducer.

5. The invention as defined in claim 1 and comprising a position transducer associated with each variable moving means, said position transducers providing a feedback output signal to said control circuit.

6. The invention as defined in claim 1 wherein said inlet vane moving means comprises a plurality of shafts, one shaft being secured to each inlet vane, said shafts being rotatably mounted to said housing so that said shafts are generally parallel to but spaced radially outwardly from said axis, and means for rotatably driving said shafts in unison with each other.

7. The invention as defined in claim 6 wherein said rotatable driving means comprises a ring rotatably mounted to said housing, means for mechanically connecting said shafts to said ring, and means for rotating said ring.

8. The invention as defined in claim 1 wherein each diffuser vane includes a slot and wherein said diffuser pivotal mounting means comprises a plurality of first pins, one first pin being secured to said housing and extend through each diffuser vane slot, a ring rotatably mounted to said housing, a plurality of second pins, one second pin being secured to said ring and pivotally secured to each diffuser vane at a position spaced from said slot, and means for rotatably moving said ring.

9. In combination:

a compressor having a rotary drive input, an air inlet and a compressed air outlet, an electrical generator having a rotary drive input, means for rotatably driving said rotary drive inputs in synchronism with each other, means for maintaining the rotational speed of said rotary drive inputs at a substantially constant and preselected speed, wherein said compressor comprises an impeller, an inlet passageway between said air inlet and one end of said impeller, a diffuser passageway extending radially outwardly from the other end of said impeller, and wherein said means for maintaining said rotary inputs at a constant and preselected speed comprises means for varying the aerodynamic geometry of said inlet passageway and said diffuser passageway.

10. The invention as defined in claim 9 wherein for varying the aerodynamic geometry of said inlet passageway comprises a plurality of vanes pivotally mounted in said inlet passageway and pivotal between an open and a closed position, and means for variably pivoting said inlet vanes in synchronism with each other to a selected position between said open and closed position.

11. The invention as defined in claim 10 wherein said means for varying the aerodynamic geometry of said diffuser passageway comprises a plurality of vanes pivotally mounted in said diffuser passageway and pivotal between an open and a closed position, and means for variably pivoting said diffuser vanes in synchronism with each other to a selected position between said open and closed position.

* * * * *

UNITED STATES PATENT AND TRADEMARK OFFICE

CERTIFICATE OF CORRECTION

PATENT NO. : 4,780,049

DATED : October 25, 1988

INVENTOR(S) : Lynn D. Palmer, et al.

It is certified that error appears in the above-identified patent and that said Letters Patent is hereby corrected as shown below:

Assigned to Teledyne Industries, Inc.

Column 1, line 4, delete "I. Field of";

line 5, before "the Invention", insert --I. Field of--.

Column 1, before "II. Description of the Prior Art", insert --The Government has rights in this invention pursuant to Contract No. F33657-83-C-2217 awarded by the Department of the Air Force.--;

Column 4, line 17, delete "212" (first occurrence), and insert --200--;

line 55, after "clockwise", insert --direction--;

Column 5, line 22, delete "both";

Colomn 6, line 17, delete "my", and insert --our --;

lines 39-40, delete "Serial No. 869,683--2";

Column 7, line 21, delete "extend", and insert --extended--;

UNITED STATES PATENT AND TRADEMARK OFFICE

CERTIFICATE OF CORRECTION

PATENT NO. : 4,780,049

DATED : October 25, 1988

INVENTOR(S) : Lynn D. Palmer, et al.

It is certified that error appears in the above-identified patent and that said Letters Patent is hereby corrected as shown below:

Column 8, line 14, after "wherein", insert --means--.

Signed and Sealed this

Twenty-fourth Day of October, 1989

*Attest:*

DONALD J. QUIGG

*Attesting Officer*

*Commissioner of Patents and Trademarks*